US005759210A

United States Patent [19]

Potter et al.

[11] Patent Number: 5,759,210

[45] Date of Patent: *Jun. 2, 1998

[54] LYOCELL FABRIC TREATMENT TO REDUCE FIBRILLATION TENDENCY

[75] Inventors: Christopher David Potter; James Martin Taylor, both of Derby, United Kingdom

[73] Assignee: Courtaulds Fibres (Holdings) Limited, United Kingdom

[ * ] Notice: The term of this patent shall not extend beyond the expiration date of Pat. No. 5,580,356.

[21] Appl. No.: 716,184

[22] PCT Filed: May 1, 1995

[86] PCT No.: PCT/GB95/00993

§ 371 Date: Sep. 27, 1996

§ 102(e) Date: Sep. 27, 1996

[87] PCT Pub. No.: WO95/30043

PCT Pub. Date: Nov. 9, 1995

[30] Foreign Application Priority Data

May 3, 1994 [GB] United Kingdom ..... 9408742

[51] Int. Cl.[6] ..... D06M 15/423; D06M 15/45

[52] U.S. Cl. ..... 8/181; 8/116.1; 8/185; 8/186; 8/120; 8/182; 8/184; 8/543

[58] Field of Search ..... 8/116.1, 181, 185, 8/186, 120, 182, 184, 543

[56] References Cited

U.S. PATENT DOCUMENTS

| | | | |
|---|---|---|---|
| 2,394,306 | 2/1946 | Hentrich et al. . | |
| 2,826,514 | 3/1958 | Schroeder . | |
| 2,892,674 | 6/1959 | Sause et al. . | |
| 2,971,815 | 2/1961 | Bullock et al. . | |
| 3,294,778 | 12/1966 | Randall et al. . | |
| 3,383,443 | 5/1968 | Leahy et al. . | |
| 3,400,127 | 9/1968 | Tesoro et al. . | |
| 3,441,367 | 4/1969 | Pierce, Jr. et al. | 8/183 |
| 3,574,522 | 4/1971 | Rowland et al. . | |
| 3,606,990 | 9/1971 | Gobert . | |
| 3,663,159 | 5/1972 | Gordon . | |
| 3,796,540 | 3/1974 | Harper, Jr. et al. | 8/185 |
| 3,849,169 | 11/1974 | Cicione et al. . | |
| 3,883,523 | 5/1975 | Parton . | |
| 3,960,983 | 6/1976 | Blank . | |
| 4,090,844 | 5/1978 | Rowland . | |
| 4,125,652 | 11/1978 | Kamminoth et al. . | |
| 4,185,961 | 1/1980 | Danzik . | |
| 4,246,221 | 1/1981 | McCorsley, III . | |
| 4,268,266 | 5/1981 | Hendricks et al. . | |
| 4,283,196 | 8/1981 | Wenghoefer . | |
| 4,336,023 | 6/1982 | Warburton . | |
| 4,371,517 | 2/1983 | Vanlerberghe . | |
| 4,416,698 | 11/1983 | McCorsley . | |
| 4,443,355 | 4/1984 | Murata et al. . | |
| 4,472,167 | 9/1984 | Welch . | |
| 4,483,689 | 11/1984 | Welch . | |
| 4,502,866 | 3/1985 | Brenneisen . | |
| 4,563,189 | 1/1986 | Lewis . | |
| 4,780,102 | 10/1988 | Harper, Jr. . | |
| 4,820,307 | 4/1989 | Welch et al. | 8/120 |
| 4,880,431 | 11/1989 | Yokogawa et al. . | |
| 4,908,097 | 3/1990 | Box . | |
| 4,971,708 | 11/1990 | Lee . | |
| 4,999,149 | 3/1991 | Chen . | |
| 5,085,668 | 2/1992 | Pelster et al. . | |
| 5,131,917 | 7/1992 | Miyamoto et al. . | |
| 5,310,424 | 5/1994 | Taylor | 8/190 |
| 5,311,389 | 5/1994 | Howey . | |
| 5,328,757 | 7/1994 | Kenney et al. . | |
| 5,403,530 | 4/1995 | Taylor . | |
| 5,580,356 | 12/1996 | Taylor | 8/116.1 |

FOREIGN PATENT DOCUMENTS

| | | |
|---|---|---|
| 40668/78 | 4/1980 | Australia . |
| 044172 | 1/1982 | European Pat. Off. . |
| 174794 | 3/1986 | European Pat. Off. . |
| 252649 | 1/1988 | European Pat. Off. . |
| 538977 | 4/1993 | European Pat. Off. . |
| 1148892 | 12/1957 | France . |
| 1318838 | 2/1963 | France . |
| 2273091 | 12/1975 | France . |
| 2352097 | 12/1977 | France . |
| 1444127 | 9/1969 | Germany . |
| 48-015234 | 5/1973 | Japan . |
| 49-80392 | 8/1974 | Japan . |
| 53-035017 | 4/1978 | Japan . |
| 53-078377 | 7/1978 | Japan . |
| 87057744 | 12/1987 | Japan . |
| 89000505 | 1/1989 | Japan . |
| 4218502 | 8/1992 | Japan . |
| 4241179 | 8/1992 | Japan . |
| 6146168 | 5/1994 | Japan . |
| 71100 | 9/1976 | Poland . |
| 543484 | 12/1973 | Switzerland . |
| 576270 | 3/1946 | United Kingdom . |
| 734974 | 8/1955 | United Kingdom . |
| 810352 | 3/1959 | United Kingdom . |
| 878655 | 10/1961 | United Kingdom . |
| 936399 | 9/1963 | United Kingdom . |
| 950073 | 2/1964 | United Kingdom . |
| 953171 | 3/1964 | United Kingdom . |
| 989873 | 4/1965 | United Kingdom . |
| 1142428 | 2/1969 | United Kingdom . |

(List continued on next page.)

OTHER PUBLICATIONS

D. Gagliardi et al, "Crosslinking of Cellulose with Polycarboxylic Acids", *American Dyestuff Reporter*, 53:300–303 (Apr. 15, 1963).

(List continued on next page.)

*Primary Examiner*—Alan Diamond
*Attorney, Agent, or Firm*—Howson and Howson

[57] ABSTRACT

The fibrillation tendency of lyocell fabrics, and the degree of fibrillation of fibrillated lyocell fabrics, can be reduced by treating such fabrics with a cross-linking agent in the presence of an acid catalyst. Good results may be obtained when the ratio by weight of the catalyst to the optional cross-linking agent is at least about 0.5:1. Good results may be obtained when the amount of cross-linking agent fixed on the fabric is in the range 0.5 to 1.5 percent on weight of fabric.

38 Claims, No Drawings

FOREIGN PATENT DOCUMENTS

| | | |
|---|---|---|
| 1271518 | 4/1972 | United Kingdom . |
| 1368599 | 10/1974 | United Kingdom . |
| 2007147 | 5/1979 | United Kingdom . |
| 2043525 | 10/1980 | United Kingdom . |
| WO92/07124 | 4/1992 | WIPO . |
| WO92/14871 | 9/1992 | WIPO . |
| WO92/19807 | 11/1992 | WIPO . |
| WO94/09191 | 4/1994 | WIPO . |
| WO94/20656 | 9/1994 | WIPO . |
| WO94/24343 | 10/1994 | WIPO . |
| WO95/28516 | 10/1995 | WIPO . |

OTHER PUBLICATIONS

*Hawley's Condensed Chemical Dictionary,* Eleventh edition, revised by N. Irving Sax et al. Van Nostrand Reinhold Co., New York, pp. 231–232 (1987).

"Radiopaque Polymers to Safety", Encyclopedia of Polymer Science and Engineering, vol. 14, pp. 45–46, 57–59, John Wiley & Sons, Inc. (1988) (month unknown).

"Styrene Polymers to Toys", Encyclopedia of Polymer Science and Engineering, vol. 16, pp. 16 and 685, John Wiley & Sons, Inc. (1989) (month unknown).

R. Moncrieff, "Man–Made Fibres", 6th Edition, 6:882–895, 900–925 (1975) (Month Unknown).

"Textile Resins", in Encyclopedia of Polymer Science and Technology, 16:682–699 (1989) (Month Unknown).

"Dyeing" in Encyclopedia of Polymer Science and Engineering, 5:226–245 (1986) (Month Unknown).

S. Kulkami et al, "Textile Dyeing Operations", pp. 2–3, 84–105 (1986) (Month Unknown).

"Dyes, Reactive" in Kirk–Othmer, Encyclopedia of Chemical Technology, 3rd edition, 8:374–385 (1979) (Month Unknown).

R. Rosenthal, "Genesis" Fiber Developed by Courtaulds, Nonwovens Ind., 17(8):33, Paperchem No. 57–06976 (Abstract) (Aug., 1986).

"New Generation of Cellulose Fibers", Melliand Textilberichte/International Textile Reports, 72(2):94, Textile Technol. Dig. No. 03135/91 (Abstract) (Feb., 1991).

"Lenzing Opens Solvent–Spinning Line for Cellulose Fibres", Nonwovens Rep. Int., 237:6–7, Pira Abstract No. 07–91–00562 (Abstract) (Dec., 1990).

J. Marsh, "An Introduction to Textile Finishing", 2d ed., Chapman and Hall Ltd. (London, 1966) (Month Unknown).

Ullmann's Encyclopedia of Industrial Chemistry, Fifth, Completely Revised Edition, vol. A10: "Ethanolamines to Fibers, 4. Synthetic Organic", Section 4.2.2. Washing and Finishing, VCH (Weinheim, 1987) (Month Unknown).

R. Moncrieff, "Man–Made Fibres", 5th ed., p. 211 (1970) (Month Unknown).

"Man–Made Fibers Science and Technology", vol. 2, p. 33, Interscience Publishers (1968) (Month Unknown).

E. Flick, "Textile Finishing Chemicals, An Industrial Guide", p. 372 (Mar., 1990).

S. Anand et al, "The Dimensional Properties of Single–Jersey Loop–Pile Fabrics, Part II: Studies of Fabrics with Textured Continuous–filament Yarns in the Ground Structure", J. Text. Inst., 5:349 (1987) (Month Unknown).

A. Hebeish et al, "Chemical Modification of Cotton Through Reaction with Alkoxy Adducts of Acrylamide and Hexahydro–1,3,5–triacryloyl–s–triazine in Nonaqueous Medium", Angew. Makromol. Chem., 91:77–97 (1980) (Abstract only) (Month Unknown).

S. Rowland et al, "Polymerization–crosslinking of N–methylolocrylamide in Cotton Fabric", Text. Res. J., 48(2):73–80 (1978) (Abstract only) (Month Unknown).

M. Solarz, "Modification of Cellulose Fibers with N, N'–methylenebisacrylamide", Przegl. Wlok., 30(11–12):546–549 (1976) (Abstract only) (Month Unknown).

M. Kamel et al, Creaction of Reaction Centers on Cotton, III., Synthesis of Some New Methylolacrylamide Derivatives, Kolor. Ert., 17(7–8):217–224 (1975) (Abstract only) (Month Unknown).

G. Valk et al, "Creation of Reactive Centers on Cellulose Using Hexahydro–1,3,5–triacryloyl–s–triazine", Text. Res. J., 41(4):364 (1971) (Abstract only) (Month Unknown).

G. Valk et al, "Analysis of High–Grade Finishes, 7., Chemical Detection of the Cross–linking of Cotton with N–acrylamide Derivatives", Melliand Textilber., 51(6):714–719 (1970) (Abstract only) (Month Unknown).

R. Harper, "Crosslinking, Grafting and Dyeing: Finishing for Added Properties", Textile Chemist and Colorist, 23(11):15–20 (Nov., 1991).

"Sulfonation and Sulfation to Thorium and Thorium Compounds"in Kirk–Othmer, Encyclopedia of Chemical Technology, 3rd edition, vol. 22, pp. 769–790 (1983) (Month Unknown).

H. Petersen, "The Chemistry of Crease–Resist Crosslinking Agents", Rev. Prog. Coloration, 17:7–22 (1987) (Month Unknown).

P. Pavlov et al, "Properties of Viscose Fibres Modified in an As–spun State by Cross–Linking", J. Textile Institute, 78(5):357–361 (Sep.–Oct., 1987).

M. Dube et al, "Precipitation and Crystallization of Cellulose from Amine Oxide Solutions", in Proceedings of the Technical Association of the Pulp and Paper Industry, 1983 International Dissolving and Speciality Pulps Conference, Tappi Press, pp. 111–119 (1983) (Month Unknown).

M. Hurwitz et al, "Dialdehydes as Cotton Cellulose Cross–Linkers", Textile Research Journal, 28(3):257–262 (Mar., 1958).

H. Nemec, "Fibrillation of Cellulosic Materials –Can Previous Literature Offer a Solution?", Lenzinger Berichte, 9:69–72 (Sep., 1994).

Andrews et al, "Eficient Ester Crosslink Finishing for Formaldehyde–Free Durable Press Cotton Fabrics", American Dyestuff Reporter, vol. 78, pp. 15–18, 23 (Jun. 1989).

Gagliardi et al, "Crosslinking of Cellulose with Polycarboxylic Acids" American Dyestuff Reporter, pp. 74–77 (Apr. 15, 1963).

Welch, "Tetracarboxylic Acids as Formaldehyde–Free Durable Press Finishing Agents", Textile Research Journal, vol. 58, pp. 480–486 (Aug. 1988).

LYOCELL FABRIC TREATMENT TO REDUCE FIBRILLATION TENDENCY

This application is a 371 of PCT/GB95/00993 filed May 1, 1995.

FIELD OF THE INVENTION

This invention relates to methods of reducing the fibrillation tendency of lyocell fabrics and of reducing the degree of fibrillation of fibrillated lyocell fabrics.

It is known that cellulose fibre can be made by extrusion of a solution of cellulose in a suitable solvent into a coagulating bath. This process is referred to as "solvent spinning", and the cellulose fibre produced thereby is referred to as "solvent-spun" cellulose fibre or as lyocell fibre. Lyocell fibre is to be distinguished from cellulose fibre made by other known processes, which rely on the formation of a soluble chemical derivative of cellulose and its subsequent decomposition to regenerate the cellulose, for example the viscose process. One example of the solvent-spinning process is described in U.S. Pat. No. 4,246,221, the contents of which are incorporated herein by way of reference. Cellulose is dissolved in a solvent such as an aqueous tertiary amine N-oxide, for example N-methylmorpholine N-oxide. The resulting solution is then extruded through a suitable die into an aqueous bath to produce an assembly of filaments, which is washed in water to remove the solvent and is subsequently dried.

As used herein, the term "lyocell fibre" means a cellulose fibre obtained by an organic solvent spinning process, in which the organic solvent essentially comprises a mixture of organic chemicals and water, and in which solvent spinning involves dissolving cellulose in the solvent and spinning, without formation of a derivative of the cellulose. As used herein, the terms "solvent-spun cellulose fibre" and "lyocell fibre" are synonymous. As used herein, the term "lyocell fabric" means a fabric woven or knitted from a plurality of yarns, at least some of which yarns contain lyocell fibre, alone or in blend with other type(s) of fibre.

Fibres may exhibit a tendency to fibrillate, particularly when subjected to mechanical stress in the wet state. Fibrillation occurs when fibre structure breaks down in the longitudinal direction so that fine fibrils become partially detached from the fibre, giving a hairy appearance to the fibre and to woven or knitted fabric containing it. Dyed fabric containing fibrillated fibre tends to have a "frosted" appearance, which may be aesthetically undesirable. Such fibrillation is believed to be caused by mechanical abrasion of the fibres during treatment in a wet and swollen state. Wet treatment processes such as dyeing processes inevitably subject fibres to mechanical abrasion. Higher temperatures and longer times of treatment generally tend to produce greater degrees of fibrillation. Lyocell fabric appears to be particularly sensitive to such abrasion and is consequently often found to be more susceptible to fibrillation than fabric made from other types of cellulose fibre. In particular, cotton fabrics have an inherently very low fibrillation tendency.

BACKGROUND ART

It has been known for many years to treat cellulose fabric with a crosslinking agent to improve its crease resistance, as described for example in Kirk-Othmer's Encyclopaedia of Chemical Technology, third edition, Volume 22 (1983), Wiley-Interscience, in an article entitled "Textiles (Finishing)" at pages 769–790, and by H. Petersen in Rev. Prog. Coloration, Vol 17 (1987), pages 7–22. Crosslinking agents may sometimes be referred to under other names, for example crosslinking resins, chemical finishing agents and resin finishing agents. Crosslinking agents are small molecules containing a plurality of functional groups capable of reacting with the hydroxyl groups in cellulose to form crosslinks. In one conventional type of finishing process, a cellulosic fabric is first treated with a crosslinking agent, for example by application from a pad bath, and is dried and then heated to cure the resin and induce crosslinking (pad-dry-cure). It is known that crease-resistant finishing treatments embrittle cellulose fabric, with consequent loss of abrasion resistance, tensile strength and tear strength. Cost is an important factor in the choice of finishing system.

One known class of crosslinking agents consists of the N-methylol resins, that is to say small molecules containing two or more N-hydroxymethyl or N-alkoxymethyl, in particular N-methoxymethyl, groups. N-methylol resins are generally used in conjunction with acid catalysts chosen to improve crosslinking performance. In a typical process, a solution containing about 5–9% by weight N-methylol resin crosslinking agent and 0.4–3.5% by weight acid catalyst is padded onto dry cellulosic fabric to give 60–100% by weight wet pickup, after which the wetted fabric is dried and then heated to cure and fix the crosslinking agent. Typically, about 70 or 75% by weight of the crosslinking agent may become fixed to the fabric. The ratio of acid catalyst to crosslinking agent is chosen to be as low as possible consistent with efficient reaction. Use of high levels of catalyst adds to the cost of the treatment and may cause breakdown of the crosslinking resin and acid damage to the cellulose. Acid damage causes loss of fabric strength. Most typically, the ratio by weight of catalyst to crosslinking agent is in the range from about 1:4 to 1:20.

DISCLOSURE OF THE INVENTION

The present invention provides a method of providing a lyocell fabric with a reduced fibrillation tendency, including the steps of:

(a) contacting the fabric with an aqueous liquor containing an acid catalyst and optionally a crosslinking agent, and (b) heating the fabric, characterised in that the ratio by weight of the catalyst to the optional crosslinking agent is at least about 0.5:1.

The invention further provides a method of reducing the degree of fibrillation of a fibrillated lyocell fabric, including the steps of:

(a) contacting the fabric with an aqueous liquor containing an acid catalyst and optionally a crosslinking agent, and (b) heating the fabric, characterised in that the ratio by weight of the catalyst to the optional crosslinking agent is at least about 0.5:1.

The invention further provides a method of providing a lyocell fabric with a reduced fibrillation tendency, including the steps of:

(a) contacting the fabric with an aqueous liquor containing an acid catalyst and a crosslinking agent, and (b) heating the fabric to cure the crosslinking agent, characterised in that the amount of crosslinking agent thereby fixed on the fabric is in the range 0.5 to 1.5 percent on weight of fabric.

The invention further provides a method of reducing the degree of fibrillation of a fibrillated lyocell fabric, including the steps of:

(a) contacting the fabric with an aqueous liquor containing an acid catalyst and a crosslinking agent, and (b) heating the fabric to cure the crosslinking agent, characterised in that the amount of crosslinking agent thereby fixed on the fabric is in the range 0.5 to 1.5 percent on weight of fabric.

It is known that conventional crosslinking treatments can reduce the tendency of lyocell fabrics to fibrillate. It has remarkably now been found that the same type of effect can be produced even if the treatment liquor contains no crosslinking agent at all or a surprisingly low level of crosslinking agent.

The acid catalyst may be an amine salt catalyst, such as ammonium sulphate, but it is preferably a metal salt catalyst of the Lewis acid type. Preferred catalysts include magnesium chloride, zinc chloride, zinc fluoroborate, zinc nitrate and mixtures thereof. The acid catalyst may alternatively be a water-soluble organic acid, such as an optionally substituted carboxylic acid, preferably aliphatic, advantageously one which is involatile under the conditions employed in the heating step. Examples of suitable organic acids include tartaric acid and in particular citric acid. Mixtures of acid catalysts may also be used.

The concentration of acid catalyst in the treatment liquor depends to some extent on the nature of the acid catalyst used. The concentration should not be so high that significant acid damage to the fabric occurs in the heating step. The concentration may be lower with highly active acid catalysts than with less active acid catalysts. The concentration of a highly active metal salt catalyst may generally be in the range from about 2 to about 20 grams/liter, often about 5 to about 10 grams/liter. The concentration of a less active catalyst, for example an amine salt catalyst, may be up to about 40 grams/liter. The concentration of an organic acid catalyst is generally in the range 1 to 10 grams/liter. A preferred concentration of citric acid is 4 to 6 grams/liter.

The pH of the aqueous liquor is in general mildly acidic.

The aqueous liquor may be applied to the fabric by conventional means used in finishing treatments for cellulosic fabrics, for example a pad bath.

After application of the aqueous liquor, the fabric is preferably dried before the heating step. This drying step may be performed as a preliminary stage in the heating step.

The heating step may in general be performed under conditions similar to those used to cure crosslinking resins in conventional crosslinking treatments, for example at a temperature in the range 125° to 180° C. for 30 seconds to 5 minutes, higher temperatures generally corresponding to shorter heating times. Heating conditions should be chosen so as to minimise the possibility of acid damage to the fabric.

The optional crosslinking agent may be any crosslinking agent known in the art for finishing cellulosic textiles.

When the aqueous liquor contains the optional crosslinking agent, the amount of the agent may be such that the amount fixed is 0.5 to 1.5 percent by weight on the lyocell fabric. This is considerably lower than in conventional crease-resistant finishing techniques, where the amount of agent fixed is commonly around 3 percent on weight of fabric. The optional crosslinking agent is preferably of the low-formaldehyde type, for example an N-methylol resin, or of the zero-formaldehyde type.

It is known that fibrils can be removed from fibres in fibrillated lyocell fabrics by treatment with a cellulase enzyme. The present invention provides a cheaper, quicker and simpler way of removing such fibrils. Although use of the invention generally produces some reduction in fabric tensile properties, the extent of such reduction is in general comparable to the commercially-acceptable reduction occasioned by such known cellulase treatment.

As hereinabove described and hereinabove used, the term "fibrillation" means the partial detachment of long fibrils or hairs from a fibre, in consequence of which fabric containing the fibre exhibits an undesirable hairy appearance and dyed fabric containing the fibre exhibits frostiness. This type of fibrillation may also be called primary fibrillation. The term "fibrillation" may also be used to describe another phenomenon, which may be called secondary fibrillation. In secondary fibrillation, short fibrils become partially detached from the fibres in a fabric but remain largely within the structure of the fabric. This imparts a desirable peach-skin finish to the fabric. Furthermore, whereas primary fibrillation often occurs in localised patches on a fabric, the distribution of secondary fibrillation is generally much more uniform. Any difference in dyeability between the bulk of the fibres and the secondary fibrils does not give rise to objectionable visual effects such as frostiness in fabric with peach-skin finish. Accordingly, secondary fibrillation may produce a desirable effect, provided always that primary fibrillation can be avoided. It will be understood that the fibrillation referred to hereinabove in relation to the methods of the invention is primary fibrillation. It has further been found that the methods of the invention may serve desirably to induce secondary fibrillation.

Materials were assessed for degree of fibrillation using the method described below as Test Method 1.

TEST METHOD 1 (ASSESSMENT OF FIBRILLATION)

There is no universally accepted standard for assessment of fibrillation, and the following method was used to assess Fibrillation Index (F.I.). Samples of fibre were arranged into a series showing increasing degrees of fibrillation. A standard length of fibre from each sample was then measured and the number of fibrils (fine hairy spurs extending from the main body of the fibre) along the standard length was counted. The length of each fibril was measured, and an arbitrary number, being the number of fibrils multiplied by the average length of each fibril, was determined for each fibre. The fibre exhibiting the highest value of this arbitrary number was identified as being the most fibrillated fibre and was assigned an arbitrary Fibrillation Index of 10. A wholly unfibrillated fibre was assigned a Fibrillation Index of zero, and the remaining fibres were graded from 0 to 10 based on the microscopically measured arbitrary numbers.

The measured fibres were then used to form a standard graded scale. To determine the Fibrillation Index for any other sample of fibre, five or ten fibres were visually compared under the microscope with the standard graded fibres. The visually determined numbers for each fibre were then averaged to give a Fibrillation Index for the sample under test. It will be appreciated that visual determination and averaging is many times quicker than measurement, and it has been found that skilled fibre technologists are consistent in their rating of fibres.

The Fibrillation Index of fabrics can be assessed on fibres drawn from the surface of the fabric. Woven and knitted fabrics having an F.I. of more than about 2.0 to 2.5 exhibit an unsightly appearance.

The invention is illustrated by the following Examples. In all cases, the lyocell fabrics used consisted solely of lyocell fibres. Lyocell fibre is available from Courtaulds Fibres (Holdings) Limited under the Trade Mark TENCEL.

EXAMPLE 1

A dyed woven lyocell fabric was laundered to develop fibrillation (F.I.=5.5). The fabric was padded with aqueous solutions containing varying amounts of Condensol FB (Trade Mark of BASF AG) and then heated under various conditions. Condensol FB is an acid catalyst based on zinc fluoroborate and magnesium chloride. The fabric was then further laundered, and the effect on fibrillation assessed. The results shown in Table 1 were obtained:

TABLE 1

| Condensol FB Conncentration | Heating | | F.I. | |
|---|---|---|---|---|
| g/l | Time mins | Temp °C. | 1 w/t | 5 w/t |
| O(Control) | — | — | 5.8 | 5.4 |
| 10 | 3 | 140 | 2.7 | 0.4 |
| | 5 | 140 | 3.4 | 0.2 |
| | 3 | 160 | 2.9 | 0.9 |
| | 1.5 | 160 | 2.4 | 0.6 |
| | 0.5 | 180 | 3.7 | 0.6 |
| 20 | 3 | 140 | 1.6 | 0.0 |
| | 5 | 140 | 1.5 | 0.2 |
| | 3 | 160 | 1.8 | 0.1* |
| | 1.5 | 160 | 1.0 | 0.0* |
| | 0.5 | 180 | 1.4 | 0.2* |

In the Table, "w/t" stands for wash and tumble, a single laundering cycle. An asterisk (*) indicates that fabric strength had been noticeably reduced. Fabric damage was marked if higher concentrations of Condensol FB (50 g/l or 100 g/l) were used.

EXAMPLE 2

Example 1 was repeated, except that the concentration of Condensol FB was 10 g/l in all cases. The results shown in Table 2 were obtained:

TABLE 2

| Heating | | F.I. | | |
|---|---|---|---|---|
| Time mins | Temp °C. | 10 w/t | 15 w/t | 20 w/t |
| 3 | 140 | 1.6 | 0.6 | 3.2 |
| 5 | 140 | 0.8 | 0.6 | 2.4 |
| 3 | 160 | 0.5 | 0.4 | 0.0 |
| 1.5 | 160 | 0.3 | 0.0 | 0.0 |
| 0.5 | 180 | 1.1 | 0.3 | 0.0 |

EXAMPLE 3

A sample of woven lyocell fabric was padded with an aqueous solution containing 10 g/l Condensol FB, dried and heated at 160° C. for 1.5 minutes. The physical properties of the fabric were assessed using standard tests. The results were as shown in Table 3:

TABLE 3

| Test | Control | Treated |
|---|---|---|
| Tensile (ravelled strip) | | |
| Warp B.L. N | 648 | 647 |
| Warp Extn % | 18.2 | 15.7 |
| Weft B.L. N | 540 | 509 |
| Weft Extn % | 17.5 | 18.5 |
| Elmendorf Tear cN | | |
| Warp | 1068 | 1149 |
| Weft | 999 | 816 |
| Pilling (11000 revs) | 2–3 | 4–5 |

TABLE 3-continued

| Test | Control | Treated |
|---|---|---|
| Martindale Abrasion (9 kPa) (B.L. = breaking load). | 10250 | 9500 |

The treated fabric had very similar properties to the control, except that pilling performance was improved.

EXAMPLE 4

Example 1 was repeated, except that zinc fluoroborate was used as acid catalyst and knitted lyocell fabric was also tested. The results shown in Table 4 were obtained:

TABLE 4

| | Heating | | Woven Fabric | | Knitted Fabric | |
|---|---|---|---|---|---|---|
| Concentration | Time | Temp | F.I. | | F.I. | |
| g/l | mins | °C. | 1 w/t | 5 w/t | 1 w/t | 5 w/t |
| O(Control) | — | — | 4.1 | 6.1 | 5.2 | 5.7 |
| 4 | 3 | 140 | 4.3 | 4.9 | 1.3 | 1.8 |
| | 5 | 140 | 3.4 | 1.9 | 2.7 | 2.9 |
| | 3 | 160 | 1.4 | 2.7 | 0.8 | 1.3 |
| | 1.5 | 160 | 2.2 | 0.9 | 1.8 | 1.9* |
| 6 | 3 | 140 | 2.2 | 1.6 | 2.5 | 1.5 |
| | 5 | 140 | 2.1 | 0.0 | 1.6 | 0.6* |
| | 3 | 160 | 0.9 | 0.0 | 1.3 | 1.3* |
| | 1.5 | 160 | 1.3 | 0.0 | 1.5 | 1.0 |

An asterisk indicates that fabric strength was reduced. Fabric damage was marked when the concentration of the catalyst was 10 g/l.

EXAMPLE 5

Example 1 was repeated, except that ammonium sulphate was used as acid catalyst. The results shown in Table 5 were obtained:

TABLE 5

| Acid Catalyst | Heating | | | |
|---|---|---|---|---|
| Concentration | Time | Temp | F.I. | |
| g/l | mins | °C. | 1 w/t | 5 w/t |
| 20 | 0.5 | 180 | 2.6 | 4.8 |
| 40 | 3 | 140 | 3.6 | 3.4 |
| 40 | 5 | 140 | 4.1 | 4.4 |
| 40 | 3 | 160 | 3.7 | 5.9 |
| 40 | 1.5 | 160 | 3.9 | 4.2 |
| 40 | 0.5 | 180 | 2.6 | 5.9 |

Fabric strength was reduced if 80 g/l ammonium sulphate was employed.

EXAMPLE 6

Rope marks are white crease-like marks on fabric where it has been subjected to continual abrasion during wet processing without change of position. They indicate areas of high fibrillation. Although it is known that treatment with cellulase enzymes can be effective in removing fibrils from fibrillated lyocell fabric, such treatment does not remove rope marks.

A sample of lyocell fabric had F.I. 1.4 in its bulk and 4.1 at rope marks. It was padded with aqueous solutions containing 10 g/l of various acid catalysts, dried and heated at 160° C. for 3 minutes. The fibrillation results shown in Table 6 were obtained:

TABLE 6

| Acid Catalyst | Rope Mark 1 w/t | Rope Mark 5 w/t | Bulk Fabric 1 w/t | Bulk Fabric 5 w/t |
|---|---|---|---|---|
| None (control) | 3.7 | 4.7 | 4.3 | 5.2 |
| Condensol FB | 2.3 | 2.2 | 1.5 | 2.6 |
| Zinc Nitrate | 0.8 | 0.4 | 0.7 | 0.8 |
| Zinc Chloride | 1.8 | 0.8 | 1.1 | 1.0 |

After laundering, the Condensol FB sample showed faint rope marks and fibrillation. The control fabric showed overall fibrillation which hid the rope mark. Both the zinc nitrate and the zinc chloride samples were clean, and the rope mark could no longer be distinguished from the bulk.

EXAMPLE 7

Woven lyocell fabric was padded with aqueous solutions containing a crosslinking agent and an acid catalyst, dried, and heated at 180° C. for 30 seconds to cure the crosslinking agent. The results shown in Table 7 were obtained:

TABLE 7

| Treatment | % Fixed Resin based on fabric | F.I. 1 w/t | F.I. 5 w/t | F.I. 10 w/t |
|---|---|---|---|---|
| Control (no crosslinking and no catalyst) | — | 2.0 | 7.4 | 4.1 |
| 17 g/l Arkofix NG conc 15 g/l Condensol FB | 1.1 | 1.3 | 0.3 | 1.8 |
| 17 g/l Arkofix NG conc 20 g/l Condensol FB | 1.2 | 0.7 | 1.0 | 0.4 |
| 50 g/l Arkofix NG conc 15 g/l Condensol FB | 3.1 | 0.8 | 0.4 | 0.7 |

Arkofix NG Conc (Trade Mark of Hoechst AG) is a low-formaldehyde crosslinking agent based on 4,5-dihydroxy-1,3-dimethyolethylene urea (DHDMEU).

Visually, the sample with 1.1% fixed resin showed fibrillation after 10 w/t cycles whilst the others appeared clean. All fabrics had good stability to washing at 60° C.

It can be seen that good results were obtained with 1.1 and 1.2% fixed resin and catalyst/resin ratios 0.9:1 and 1.2:1, as well as in the comparative experiment with 3.1% fixed resin and catalyst/resin ratio 0.3:1.

EXAMPLE 8

Woven lyocell fabric was dyed with Procion Navy HER150 (Procion is a Trade Mark of ICI plc) and laundered to develop fibrillation (F.I.=7.0). The fabric was padded with an aqueous solution containing 15 g/l zinc nitrate and dried at 110° C. Half the fabric sample was next heat-treated at 150° C. for 1 minute. All the fabric sample was then subjected to ten laundering cycles. The part of the fabric surface which had not been heat-treated was slightly cleaner than a control sample, whereas the part which had been heat-treated appeared clean to the naked eye, with no evidence of fibrillation. Microscopic examination revealed the presence of short clusters of fibrils on the fibres in the laundered fabric.

EXAMPLE 9

Lyocell fabric was dyed and laundered by the method of Example 8. Samples of the dyed fabric were padded with aqueous solutions containing 15 g/l zinc nitrate but differing in pH (4.0, 6.0, 8.0 or 10.0), dried at 110° C. and heat-treated at 150° C. for 1 minute. The metal salt precipitated from solution at pH 10.0. The fabric was then subjected to ten laundering cycles. Fabric appearance improved with decreasing pH, and the fabric treated at pH 4.0 looked very clean to the naked eye. As in Example 8, microscopic examination revealed the presence of short clusters of fibrils on the fibres in the laundered fabric.

EXAMPLE 10

Example 8 was repeated, except that an aqueous solution of citric acid (4 g/l) was used in place of the solution of zinc nitrate. The surface of the heat-treated fabric after ten launderings appeared clean, with an attractive peach-skin finish. The results of microscopic examination were similar to those of Example 8.

We claim:

1. A method of providing a lyocell fabric with a reduced fibrillation tendency, comprising the steps of:

(a) contacting the fabric with an aqueous liquor which is a solution of an acid catalyst selected from the group consisting of a metal salt catalyst which is a Lewis acid, an amine salt catalyst, and a water-soluble organic acid, and mixtures thereof, said acid catalyst present in the absence of a separate crosslinking agent; and (b) heating the fabric.

2. The method according to claim 1 wherein the concentration of the metal salt catalyst is in the range from about 2 to about 20 grams per liter.

3. The method according to claim 1 wherein said metal salt catalyst is selected from the group consisting of magnesium chloride, zinc chloride, zinc nitrate, zinc fluoroborate and mixtures thereof.

4. The method according to claim 1 wherein said amine salt catalyst is ammonium sulphate.

5. The method according to claim 1 wherein the concentration of the amine salt catalyst is up to about 40 grams/liter.

6. The method according to claim 1 wherein the concentration of the organic acid catalyst is in the rage of 1 to about 10 grams/liter.

7. The method according to claim 1, wherein the water soluble organic acid is an optionally substituted carboxylic acid.

8. The method according to claim 7, wherein said acid is an aliphatic acid involatile in said heating step.

9. The method according to 8 wherein the acid catalyst is citric acid.

10. A method of reducing the degree of fibrillation of a lyocell fabric, comprising the steps of:

(a) contacting the fabric with an aqueous liquor which is a solution of an acid catalyst selected from the group consisting of a metal salt catalyst which is a Lewis acid, an amine salt catalyst, a water-soluble organic acid and mixtures thereof, said acid catalyst present in the absence of a separate crosslinking agent; and (b) heating the fabric.

11. The method according to claim 10, wherein the concentration of the metal salt catalyst is in the range from about 2 to about 20 grams per liter.

12. The method according to claim 10, wherein the water-soluble organic acid is an optionally substituted carboxylic acid.

13. The method according to claim 12, wherein said acid is an aliphatic acid involatile in said heating step.

14. The method according to 13 wherein the acid catalyst is citric acid.

15. The method according to claim 10 wherein said metal salt catalyst is selected from the group consisting of magnesium chloride, zinc chloride, zinc nitrate, zinc fluoroborate and mixtures thereof.

16. The method according to claim 10 wherein said amine salt catalyst is ammonium sulphate.

17. The method according to claim 10 wherein the concentration of the organic acid catalyst is in the range of 1 to about 10 grams/liter.

18. The method according to claim 10 wherein the concentration of the amine salt catalyst is up to about 40 grams/liter.

19. A method of providing a lyocell fabric with a reduced fibrillation tendency, comprising the steps of:

(a) contacting the fabric with an aqueous liquor containing (i) an acid catalyst capable of catalysing the reaction of cellulose with a N-methylol resin crosslinking agent, and (ii) up to about 2 parts by weight of a N-methylol crosslinking agent for each part by weight of the acid catalyst, and (b) heating the fabric, wherein the amount of crosslinking agent fixed on the fabric is no more than 1.5 percent on weight of fabric.

20. The method according to claim 19 wherein said acid catalyst is selected from the group consisting of a metal salt catalyst which is a Lewis acid, an amine salt catalyst, and a water-soluble organic acid and mixtures thereof.

21. The method according to claim 20 wherein the concentration of the metal salt catalyst is in the range from about 2 to about 20 grams per liter.

22. The method according to claim 20, wherein the water-soluble organic acid is an optionally substituted carboxylic acid.

23. The method according to claim 22, wherein said acid is an aliphatic acid involatile in said heating step.

24. The method according to claim 20 wherein said metal salt catalyst is selected from the group consisting of magnesium chloride, zinc chloride, zinc nitrate, zinc fluoroborate and mixtures thereof.

25. The method according to 24 wherein the acid catalyst is citric acid.

26. The method according to claim 20 wherein the concentration of the organic acid catalyst is in the range of 1 to about 10 grams/liter.

27. The method according to claim 20 wherein said amine salt catalyst is ammonium sulphate.

28. The method according to claim 20 wherein the concentration of the amine salt catalyst is up to about 40 grams/liter.

29. A method of reducing the degree of fibrillation of a lyocell fabric, comprising the steps of:

(a) contacting the fabric with an aqueous liquor containing (i) an acid catalyst capable of catalysing the reaction of cellulose with a N-methylol resin crosslinking agent, and (ii) up to about 2 parts by weight of a N-methylol crosslinking agent for each part by weight of the acid catalyst, and (b) heating the fabric, wherein the amount of crosslinking agent fixed on the fabric is no more than 1.5 percent on weight of fabric.

30. The method according to claim 29 wherein said acid catalyst is selected from the group consisting of a metal salt catalyst which is a Lewis acid, an amine salt catalyst, and a water-soluble organic acid and mixtures thereof.

31. The method according to claim 30 wherein the concentration of the metal salt catalyst is in the range from about 2 to about 20 grams per liter.

32. The method according to claim 30, wherein the water-soluble organic acid is an optionally substituted carboxylic acid.

33. The method according to claim 32, wherein said acid is an aliphatic acid involatile in said heating step.

34. The method according to claim 30 wherein the acid catalyst is citric acid.

35. The method according to claim 30 wherein said metal salt catalyst is selected from the group consisting of magnesium chloride, zinc chloride, zinc nitrate, zinc fluoroborate and mixtures thereof.

36. The method according to claim 30 wherein the concentration of the organic acid catalyst is in the range of 1 to about 10 grams/liter.

37. The method according to claim 30 wherein said amine salt catalyst is ammonium sulphate.

38. The method according to claim 30 wherein the concentration of the amine salt catalyst is up to about 40 grams/liter.

* * * * *